US006530241B2

(12) United States Patent
Pozivil

(10) Patent No.: US 6,530,241 B2
(45) Date of Patent: Mar. 11, 2003

(54) APPARATUS FOR RELIQUEFYING COMPRESSED VAPOUR

(75) Inventor: Josef Pozivil, Allschwil (CH)

(73) Assignee: Cryostar-France SA, Hesingue (FR)

( * ) Notice: Subject to any disclaimer, the term of this patent is extended or adjusted under 35 U.S.C. 154(b) by 0 days.

(21) Appl. No.: 09/766,960

(22) Filed: Jan. 22, 2001

(65) Prior Publication Data

US 2001/0018833 A1 Sep. 6, 2001

(30) Foreign Application Priority Data

Jan. 26, 2000 (GB) ..... 0001801

(51) Int. Cl.[7] ..... F25J 3/00
(52) U.S. Cl. ..... 62/619; 62/48.2; 62/240
(58) Field of Search ..... 62/613, 619, 240, 62/48.2

(56) References Cited

U.S. PATENT DOCUMENTS

| | | | | |
|---|---|---|---|---|
| 2,937,503 A | * | 5/1960 | Swearingen et al. | 62/911 |
| 3,108,446 A | | 10/1963 | Sobda et al. | 62/54 |
| 3,285,028 A | | 11/1966 | Newton | 62/887 |
| 3,800,550 A | | 4/1974 | Delahunty | 62/54 |
| 3,857,245 A | | 12/1974 | Jones | 60/651 |
| 3,874,185 A | | 4/1975 | Etzbach | 62/40 |
| 3,919,852 A | | 11/1975 | Jones | 62/7 |
| 3,976,165 A | | 8/1976 | Pilarczyk | 184/6.16 |
| 4,249,387 A | | 2/1981 | Crowley | 62/54 |
| 5,412,977 A | | 5/1995 | Schmohl et al. | 73/46 |

FOREIGN PATENT DOCUMENTS

| | | | |
|---|---|---|---|
| EP | 1 472 080 | 4/1977 | |
| EP | A2 0367 156 | 5/1990 | |
| EP | 2 333 149 A | 7/1999 | |
| GB | 1414508 | 11/1975 | F25J/3/00 |
| GB | 1 471 404 | 4/1977 | |
| GB | 1 472 533 | 5/1977 | |
| WO | WO 94/17325 | 8/1994 | F17C/9/02 |
| WO | WO 98/43029 | 10/1998 | F25J/3/06 |

OTHER PUBLICATIONS

Patent Abstracts of Japan, vol. 001, No. 029 (C–010), Mar. 28, 1977 & JP 51 151264 A, Hitachi Zosen Corp., Dec. 25, 1976.

* cited by examiner

*Primary Examiner*—Ronald Capossela
(74) *Attorney, Agent, or Firm*—Wan Yee Cheung; Salvatore P. Pace

(57) ABSTRACT

An apparatus for use on board ship to reliquefy a compressed vapour employs pre-assemblies of components. The reliquefaction is effected in a closed cycle in which a working fluid is compressed in at least one compressor, is cooled in a first heat exchanger, is expanded in a turbine and is warmed in a second heat exchanger in which the compressed vapour is at least partially condensed. The apparatus comprises a first pre-assembly including the second heat exchanger and a second pre-assembly including the first heat exchanger, the compressor and the expansion turbine are positioned. The pre-assemblies are positioned on respective platforms.

10 Claims, 1 Drawing Sheet

APPARATUS FOR RELIQUEFYING COMPRESSED VAPOUR

FIELD OF THE INVENTION

This invention relates to apparatus which when assembled is operable to reliquefy a compressed vapour, particularly apparatus which is operable on board ship to reliquefy natural gas vapour.

BACKGROUND OF THE INVENTION

Natural gas is conventionally transported over large distances in liquefied state. For example, ocean going tankers are used to convey liquefied natural gas from a first location in which the natural gas is liquefied to a second location in which it is vaporised and sent to a gas distribution system. Since natural gas liquefies at cryogenic temperatures, i.e. temperatures below −100° C., there will be continuous boil-off of the liquefied natural gas in any practical storage system. Accordingly, apparatus needs to be provided in order to reliquefy the boiled-off vapour. In such an apparatus a refrigeration cycle is performed comprising compressing a working fluid in a plurality of compressors, cooling the compressed working fluid by indirect heat exchange, expanding the working fluid, and warming the expanded working fluid in indirect heat exchange, and returning the warmed working fluid to one of the compressors. The natural gas vapour, downstream of a compression stage, is at least partially condensed by indirect heat exchange with the working fluid being warmed. One example of an apparatus for performing such a refrigerant method is disclosed in U.S. Pat. No. 3,857,245.

According to U.S. Pat. No. 3,857,245 the working fluid is derived from the natural gas itself and therefore an open refrigeration cycle is operated. The expansion of the working fluid is performed by a valve. Partially condensed natural gas is obtained. The partially condensed natural gas is separated into a liquid phase which is returned to storage and a vapour phase which is mixed with natural gas being sent to a burner for combustion. The working fluid is both warmed and cooled in the same heat exchanger so that only one heat exchanger is required. The heat exchanger is located on a first skid-mounted platform and the working fluid compressors on a second skid-mounted platform. Nowadays, it is preferred to employ a non-combustible gas as the working fluid. Further, in order to reduce the work of compression that needs to supplied externally, it is preferred to employ an expansion turbine rather than a valve in order to expand the working fluid.

An example of an apparatus which embodies both these improvements is given in WO-A-98/43029. Now two heat exchangers are used, one to warm the working fluid in heat exchange with the compressed natural gas vapour to be partially condensed, and the other to cool the compressed working fluid. Further, the working fluid is compressed in two separate compressors, one being coupled to the expansion turbine. Although not disclosed in WO-A-98/43029 this conventional apparatus is so installed on board ship that the heat exchangers and the compressor which is coupled to the expansion turbine are located in the cargo machinery room of the ship and the other compressor is located within the engine room. A need arises to simplify the machinery arrangements of such an apparatus.

SUMMARY OF THE INVENTION

According to the present invention there is provided apparatus which when assembled is operable to reliquefy a compressed vapour by a method comprising performing an essentially closed refrigeration cycle comprising compressing a working fluid in at least one compressor, cooling the compressed working fluid by indirect heat exchange in a first heat exchanger, expanding the cooled working fluid in at least one expansion turbine, warming the expanded working fluid by indirect heat exchange in a second heat exchanger, and returning the warmed expanded working fluid through the first heat exchanger to the said compressor, and at least partially condensing the compressed vapour in the second heat exchanger, wherein the apparatus comprises a first support platform on which a first pre-assembly including the second heat exchanger is positioned and a second support platform on which a second pre-assembly is positioned, characterised in that the said compressor, the said expansion turbine and the first heat exchanger are all included in the second pre-assembly.

By mounting the said compressor and the said expansion turbine on the same platform, they may both be located in the engine room, or a specially ventilated cargo motor room in the deck house, of an ocean going vessel on which the apparatus is to be used. In these locations the safety requirements that the compressor and the expansion turbine are required to meet are not as high as in other parts of the ship, for example an unventilated cargo machinery room. Thus, a useful simplification of the apparatus is provided. Further, by locating the compressor and the expansion turbine on the same platform, they can be incorporated into a single machine. If desired, the said compressor and said expansion turbine can be mounted on the same shaft, or, alternatively, they may all be operatively associated with the same gear box. Not only does employing a single compression/expansion machine simplify the apparatus, it also facilitates testing of the machinery prior to assembly of the apparatus according to the invention on board ship.

Preferably, all inter-and after- coolers associated with the said compressor are located on the second platform. This provides a further simplification over the known apparatus in which the compressors are located in separate parts of the ship requiring supplies of cooling water to both such parts.

The compression/expansion machine preferably includes no more than three compression stages.

Preferably the said compressor and the said expansion turbine employ seals of a kind which minimise leakage of working fluid out of the working fluid cycle. Accordingly, instead of conventional labyrinthine seals, either dry gas seals or floating carbon ring seals are used instead. Even so, it is desirable that the apparatus includes a source of make-up working fluid. By minimising the loss of working fluid, the amount of make-up working fluid that is required is similarly minimised. Since the working fluid is typically required at a pressure in the range of 10 to 20 bar (1000 to 2000 kPa) on the low pressure side of the cycle, this helps to keep down the size of any make-up working fluid compressor that might be required. If nitrogen is selected as the working fluid, it may alternatively become possible to employ a source of nitrogen which is already at the necessary pressure and thereby obviate the need for any make-up working fluid compressor whatever. For example, the source of the make-up nitrogen may be a bank of compressed nitrogen cylinders or, if the ship is provided with a source of liquid nitrogen, a liquid nitrogen evaporator of a kind that is able to provide gaseous nitrogen at a chosen pressure in the range of 10 to 20 bar. Such liquid nitrogen evaporators are well known.

Preferably there is a third pre-assembly comprising the make-up working fluid supply means on a third platform.

Preferably the platforms used in the apparatus according to the invention are skid-mounted.

Preferably, the first heat exchanger is located within a first insulated housing and the second heat exchanger is located in a second insulated housing.

Although the apparatus according to the invention is particularly suitable for use in reliquefying natural gas, it may be employed to reliquefy the vapour of other volatile liquids or organic compounds that are transported in a tank or tanks on board a ship, or are stored in a tank or tanks forming part of an on-shore or off-shore installation.

BRIEF DESCRIPTION OF THE DRAWING

The apparatus according to the invention will now be described by way of example with reference to the accompanying drawing which is a schematic diagram illustrating the different pre-assemblies that are employed in the apparatus and the flow of fluid there through.

The drawing is not to scale.

DETAILED DESCRIPTION OF THE PREFERRED EMBODIMENTS

Figure 1:
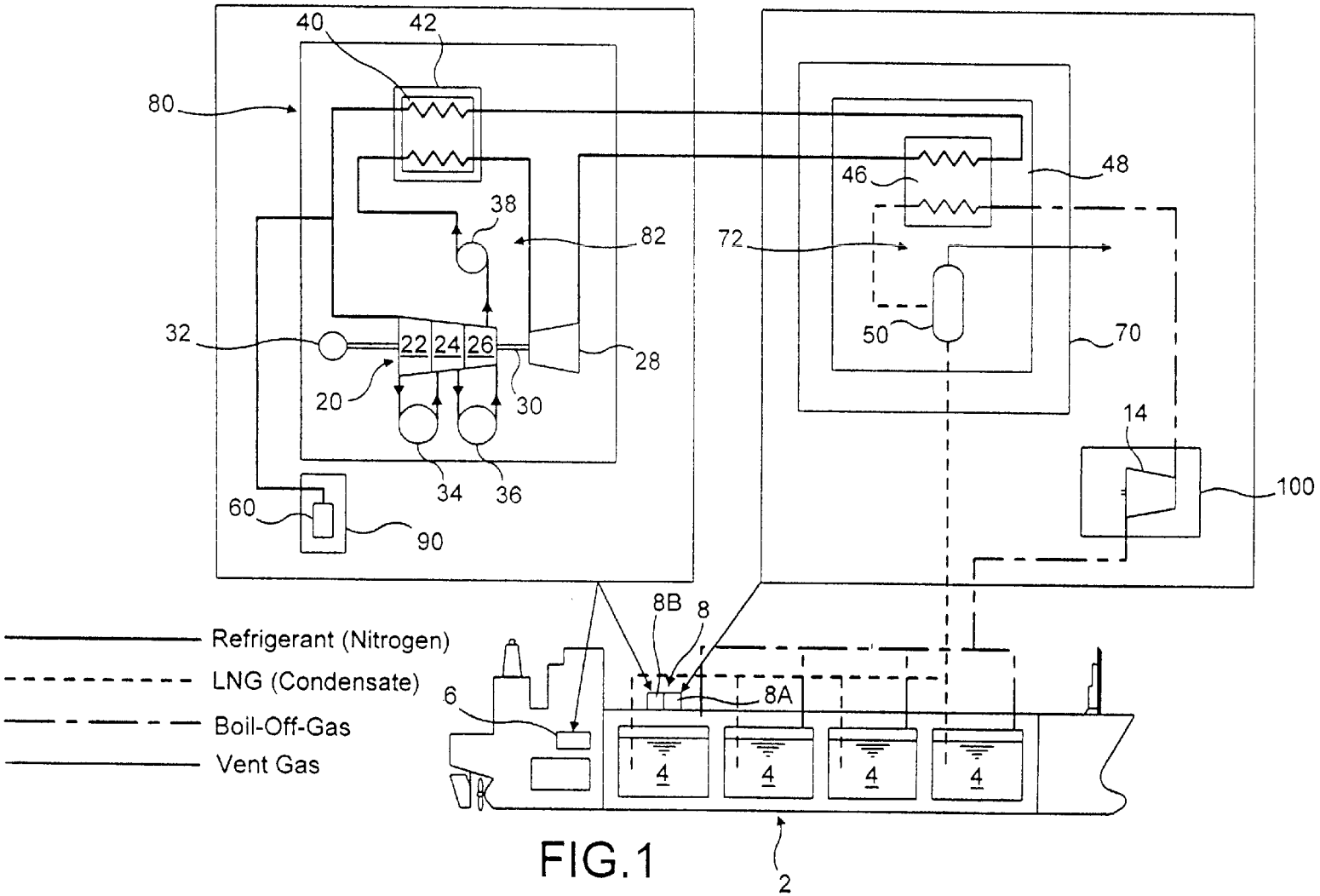

Referring to the drawing, a ship 2 has in its hold thermally insulated tanks 4 for the storage of liquefied natural gas (LNG). The ship 2 also has an engine room 6 and a deck house 8 divided into a cargo machinery room 8A which is not specially ventilated and a cargo motor room 8B which is kept safe by special ventilation.

As LNG boils at cryogenic temperatures, it is not practically possible to prevent continuous vaporisation of a small proportion of it from the storage tanks 4. The majority of the resulting vapour flows to a boil-off compressor 14, typically located in the cargo machinery room 8A with its motor located in the motor room 8B, there being a bulkhead sealing arrangement (not shown) associated with the shaft of the compressor 14. The compressor 14 raises the pressure of the excess natural gas vapour to a pressure suitable for its partial or total condensation by indirect heat exchange with a working fluid. (Conventionally, i.e. if there is no vapour reliquefaction apparatus, the boil-off gas is used to heat a boiler or boilers associated with a steam turbine propulsion system or is used in a diesel or gas engine. Typically, in the apparatus according to the invention, any excess vapour can be so used.) The working fluid, typically nitrogen, flows in an essentially closed cycle which will now be described.

Nitrogen working fluid at the lowest pressure in the cycle is received at the inlet to the first compression stage 22 of a single compression/expansion machine 20 (sometimes referred to as a "compander") having three compression stages 22, 24 and 26 in series, and downstream of the compression stage 26, a single turbo-expander 28. The three compression stages and the turbo-expander are all mounted on the same drive shaft 30 which is driven by an electric motor 32 or other suitable driving means. In an alternative arrangement, the compression stages 22, 24, 26 and a turbo-expander 28 may all be operatively associated with a gear box (not shown) and have independent drive shafts (not shown). Whatever the arrangement, however, the compression-expansion machine 20 including the motor 32 is located either in the engine room 6 or in the cargo motor room 8B. In operation, nitrogen flows in sequence through the compression stages 22, 24 and 26 of the compression-expansion machine 20. Intermediate stages 22 and 24 it is cooled to approximately ambient temperature in a first interstage cooler 34 and, intermediate compression stages 24 and 26, the compressed nitrogen is cooled in a second interstage cooler 36. Further, the compressed nitrogen leaving the final compression stage 26 is cooled in an after-cooler 38. Water for the coolers 34, 36 and 38 may be provided from the ship's clean water circuit (not shown) and spent water from these coolers may be returned to the water purification system (not shown) of this circuit on board the ship 2.

Downstream of the after-cooler 38 the compressed nitrogen flows through a first heat exchanger 40 in which it is further cooled by indirect heat exchange with a returning nitrogen stream. The heat exchanger is located in a thermally-insulated container 42 sometimes referred to as a "cold box". The heat exchanger 40 and its thermally-insulated container 42 are, like the compression-expansion machine 20, located in the engine room 6 or in the cargo motor room 8B of the ship 2.

The resulting compressed, cooled, nitrogen stream flows to the turbo-expander 28 in which it is expanded with the performance of external work. The external work is providing a part of the necessary energy needed to compress the nitrogen in the compression stages 22, 24, 26. Accordingly, the turbo-expander 28 reduces the load on the motor 32. The expansion of the nitrogen working fluid has the effect of further reducing its temperature. As a result it is at a temperature suitable for the partial or total condensation of the compressed natural gas vapour. The expanded nitrogen working fluid flows to a second heat exchanger 46, located in a thermally-insulated container ("cold box") 48 and either partially or totally condenses the compressed natural gas vapour passing countercurrently therethrough from the compressor 14. The heat exchanger 46 and its container 48 are located in the cargo machinery room 8A.

The nitrogen working fluid, now heated as a result of its heat exchange with the condensing natural gas vapour, flows back through the first heat exchanger 40 thereby providing the necessary cooling for this heat exchanger and from there to the inlet of the first compression stage 22 thus completing the working fluid cycle.

Although it is possible to liquefy the entire flow of natural gas through the heat exchanger 46, as can be deduced from the drawing, only some (typically from 80 to 99%) of the natural gas is in fact condensed. In accordance with long established and well known principles of thermodynamics, the yield of the condensate depends on the pressure and temperatures at which the condensation takes place. The mixture of condensate and residual vapour flows to a phase separator 50 (located in the cold box 48) in which the liquid phase is disengaged from the vapour phase. The liquid is returned from the phase separator 50 to the tanks 4. The remaining vapour may be sent to any auxiliary boiler, to the vented to the atmosphere, depending on its composition.

In operation of the apparatus shown in the drawing, the boiled-off natural gas typically leaves the compressor 14 at a pressure in the order of 4.5 bar and a temperature in the order of −70° C. and typically leaves the heat exchanger 46 at a temperature in the range of −140° C. to −150° C. depending on its composition and depending on the proportion of it that is condensed. The circulating nitrogen working fluid typically enters the first compression stage 22 at a temperature in the range of 20 to 40° C. and a pressure in the range of 12 to 16 bars. The nitrogen leaves the after-cooler 38 typically at a temperature in the range of 25 to 50° C. and a pressure in the range of 40 to 50 bar. It is typically cooled to a temperature in the order of −110 to −120° C. in the first heat exchanger 40. It is expanded in the turbo-expander 28 to a pressure in the range of 12 to 16 bar and a temperature sufficiently low to effect the desired condensation of the natural gas in the second heat exchanger 46.

Although the nitrogen working fluid cycle is essentially closed, there is typically a small loss of nitrogen through the seals of the various compression and expansion stages of the compression-expansion machine 20. As mentioned above, such losses can be minimised by appropriate selection of seals. Nonetheless, it is desirable to provide the closed circuit with make-up nitrogen. This is preferably done at the lowest nitrogen pressure in the circuit. To this end, the apparatus according to the invention preferably includes a supply 60 of make-up nitrogen. The supply 60 may for example comprise a bank of nitrogen cylinders. It is also possible, if it contains minimal hydrocarbons, to use the nitrogen obtained as the vapour phase in the phase separator 50 for this purpose. If this is done, however, a small make-up compressor (not shown) will be needed so as to raise the nitrogen to the inlet pressure of the first compression stage 22.

In accordance with the invention, the apparatus embodying the nitrogen-working fluid cycle are put together in two pre-assemblies which are located on respective skid-mounted platforms. Thus, the second heat exchanger 46, its thermally-insulated container 48, and the phase separator 50, which is preferably located in the same thermally-insulated container as the heat exchanger 46 and all the necessary piping are pre-assembled to form a first pre-assembly 72. The first pre-assembly is mounted on a first skid-mounted platform 70. The compression-expansion machine 20 and the heat exchanger 40 and its thermally-insulated container 42 and all the necessary piping are pre-assembled to form a second pre-assembly 82 on a second skid-mounted platform 80. If desired, the make-up nitrogen supply means 60 may be provided on a third skid-mounted platform 90. It is also possible to locate the boil-off compressor on a fourth skid-mounted platform 100 located in the cargo machinery room 8A. The pre-assemblies assemblies are preferably tested at the site of pre-assembly, transported to the ship or other vessel in which they are to be located and then joined together in an appropriate manner using thermally insulated piping or conduits to enable the apparatus to function in accordance with the invention.

Various changes and additions may be made to the apparatus according to the invention. For example, as previously stated, all the natural gas vapour entering the second heat exchanger 44 may be condensed therein thereby enabling the phase separator 50 to be omitted. Further, if desired, the working fluid cycle may be employed to generate an excess of refrigeration over that required for the partial or total condensation of the natural gas vapour. If so, such additional refrigeration may be employed in another cooling duty and an additional heat exchanger may be provided so as to perform that duty.

I claim:

1. An apparatus which when assembled is operable to reliquefy a compressed vapour by an essentially closed refrigeration cycle with a working fluid, the apparatus comprising:

a compressor for compressing the working fluid;

a first heat exchanger for cooling the compressed working fluid by indirect heat exchange;

an expansion turbine for expanding the cooled working fluid;

a second heat exchanger for warming the expanded working fluid by indirect heat exchange with the compressed vapour thereby at least partially condensing the compressed vapour, and a return path for the warmed expanded working fluid to the first heat exchanger and the compressor;

wherein the second heat exchanger forms a part of a first pre-assembly positioned on a first support platform; and the compressor, the expansion turbine and the first heat exchanger form a part of a second pre-assembly positioned on a second support platform.

2. The apparatus as claimed in claim 1 which the compressor and the expansion turbine are incorporated into a single machine.

3. The apparatus as claimed in claim 1 in which all inter- and after-coolers associated with the compressor are located on the second platform.

4. The apparatus as claimed in claim 2 in which the compressor and the expansion turbine employ dry gas seals or floating carbon ring seals so as, in operation, to minimise leakage of working fluid out of the working fluid cycle.

5. The apparatus as claimed in claim 1 additionally including a source of make-up working fluid.

6. The apparatus as claimed in claim 5 additionally including a third pre-assembly comprising make-up working fluid supply means on a third platform.

7. The apparatus as claimed in claim 1 in which the first and second platforms are skid-mounted.

8. The apparatus as claimed in claim 1 additionally including means for returning unliquefied vapour to a storage tank from which the vapour to be reliquefied is evolved.

9. The apparatus as claimed in claim 1 additionally including means for passing unliquefied vapour to the suction of a gas turbine or a diesel engine.

10. A ship or ocean going vessel incorporating the apparatus as claimed in claim 1.

* * * * *